United States Patent [19]

Spring

[11] 4,372,078

[45] Feb. 8, 1983

[54] TOY MOVABLE BY ALTERNATELY RELOCATING INDIVIDUAL MEMBERS OF A PAIR OF BODY PARTS

[75] Inventor: Gorden W. Spring, Norwalk, Calif.

[73] Assignee: Tomy Corporation, Carson, Calif.

[21] Appl. No.: 206,345

[22] Filed: Nov. 13, 1980

[51] Int. Cl.[3] ..... A63H 11/00

[52] U.S. Cl. ..... 46/150

[58] Field of Search ..... 46/102, 105, 110, 149, 46/150, 266, 98, 97

[56] References Cited

U.S. PATENT DOCUMENTS

| | | | |
|---|---|---|---|
| 1,035,098 | 8/1912 | Müller | 46/105 |
| 1,105,652 | 8/1914 | Hall | 46/98 |
| 1,724,094 | 8/1929 | Kuen | 46/150 |
| 2,022,861 | 12/1935 | Long | 46/105 |
| 2,024,135 | 12/1935 | Baker | 46/149 X |
| 2,036,427 | 4/1936 | Meler | 46/149 X |
| 2,715,793 | 8/1955 | Strauss | 46/107 |
| 3,210,886 | 10/1965 | Glass et al. | 46/232 |
| 3,678,617 | 7/1972 | Nomura | 46/266 X |

FOREIGN PATENT DOCUMENTS

| | | | |
|---|---|---|---|
| 5978 | of 1900 | United Kingdom | 46/150 |
| 1430513 | 3/1976 | United Kingdom | 46/109 |

*Primary Examiner*—F. Barry Shay

*Attorney, Agent, or Firm*—K. H. Boswell; Edward D. O'Brian

[57] ABSTRACT

A toy has a first body section and a second body section which are preferedly each shaped as one unit of a matched pair; for example, a pair of shoes. A crank extends transversely between the bodies and is rotatably connected to each. The crank includes a first crank section and a second crank section connected together by a connecting section such that the first and second crank sections are parallel but non axial. One of the bodies, because they are connected together by the crank, can be located longitudinally in front of the other body. Upon rotation of the crank the second body moves through an arcuate pathway until it is located in front of the first body. Then the first body moves through an arcuate pathway to once again located it in front of a second body. Each of the first and second bodies includes a surface engagement member which is capable of engaging the support surface such that when the first body moves through its arcuate pathway and a portion of its weight is lifted above the support surface, it is not capable of tilting the second body with respect to the support surface and vice versa for the surface engagement member associated with an other body.

23 Claims, 6 Drawing Figures

TOY MOVABLE BY ALTERNATELY RELOCATING INDIVIDUAL MEMBERS OF A PAIR OF BODY PARTS

BACKGROUND OF THE INVENTION

This invention is directed to a toy which has two similar body parts which alternately are capable of moving one in front of the other to cause locomotion of the body across a surface. The body parts are connected by a crank means which governs the locomotion of the toy.

Many toys are constructed which utilize a crank to propagate or direct certain motions of or within the toy. Commonly associated with the crank will be a connecting rod allowing conversion of rotating motion to linear motion or vice versa. Commonly a wheel or the like will be attached to the crank and will be rotated by the crank or an appendage will be pivotedly mounted within a toy and attached to the connecting rod and thus will oscillate in response to the rotation of the crank.

A few examples exist however wherein leg like appendages have been linked to cranks and are used to move the toy. Examples of this are found in U.S. Pat. No. 2,024,135 wherein an upright figure is described as movable in response to a motion of two legs positioned on crank pin portions of a crank. This principle is extended in U.S. Pat. No. 2,036,427 wherein four legs are utilized to move a toy. Each of these four legs is positioned on the crank pin portion of two vertically stacked cranks and opposite pairs of the legs are also coordinated. In U.S. Pat. No. 3,678,617 a toy having eight legs is described. The eight legs are formed on four "U" shaped members, the parallel sections of the "U" each forming a leg.

In all of the toys mentioned in the above preceding paragraph the toys are propelled by two or more legs which are attached to a body via a crank shaft or the like. All of these rely on having some sort of connecting means between the legs in order to maintain the appropriate orientation of the legs with respect to a supporting surface. Further in these toys either the housing, the double crank, or the "U" shaped member also maintains the legs in a parallel relationship with one another. Heretofore it has not been known to have a toy wherein two body halves are connected together with only a single crank.

The toys noted in the patents listed above have certain play value because of the interesting manner in which they move on a surface. By incorporating cranks directly with the movable supporting members of these toys an almost walking like motion is imparted to the toy. It is considered that a toy which could move with a walking like motion but which did not require a plurality of legs such as four or more or a housing in which two or more legs are attached would be a very novel toy and thus of considerable play value.

BRIEF SUMMARY OF THE INVENTION

In view of the above it is the broad object of the invention to provide a toy which provides for a first and second body which are preferadly shaped each as one unit of a matched pair such as a pair of shoes which are capable of a step like or walking like motion. It is a further object to provide such a toy which is simple in construction and thus economically manufactured and capable of easy manipulation by a child.

Other objects as will become evident from the remainder of this specification are achieved in a toy which comprises a first body and a second body associated with each other; a crank means extending transversely between said first and said second bodies and rotatably connected to both of said first and said second bodies; said first and said second bodies moving on a support surface with respect to one another about said crank means, said movement including in a first instance having both of said bodies located on said support surface with said first body longitudinally displaced in a first position with respect to said second body followed by said second body moving through a pathway until said second body is repositioned on said support surface longitudinally with respect to said first body followed by said first body moving through a pathway until said first body is repositioned longitudinally with respect to said second body to locate said first and said second bodies back in said first position; each of said first and said second bodies including a surface engagement means associated with it and capable of engaging said support surface, one of said engagement means of one of said first and said second bodies engaging said support surface as said first body moves in its pathway and the other of said engagement means of said first and said second bodies engaging said support system as said second body moves in its pathway, said one of said surface engagement means which engages the said surface as said first body moves in its pathway being capable of impeding said second body from moving with respect to said support surface as said first body moves in its pathway, the other of said surface engagement means which engages with said surface as said second body moves in its pathway being capable of impeding said first body from moving with respect to said surface as said second body moves in its pathway.

In the preferred embodiment of the above described toy each of the first and second bodies is preferedly capable of moving in a pathway which is semicircular, i.e., a 180 degree arc. Because of this arcuate movement at least a portion of each of the first and second bodies would be lifted above the support surface as the body moves through its pathway. Each of the engagement means when engaged with the support surface would be capable of preventing the weight of the body which is lifted off of the support surface from tilting the other body with respect to the support surface, that is the lifted body would not cause the stationary body to roll (in respect to a pitch, roll, yaw axis) with respect to the support surface.

Preferedly the crank means comprises a simple crank of the type having two parallel but non axial sections connected together with a connecting section which is perpendicular to each of the parallel sections. The crank means would also include a motor capable of rotating the crank. Each of the bodies would include appropriate bearing surfaces for mounting the crank within the bodies.

Preferably the bodies are almost identical, being halves of pairs such as pairs of shoes. Thus the bodies would be of similar if not equal longitudinal dimensions. Because they are connected together by the crank the bodies would be capable of being positioned on a support surface such that one is slightly ahead of the other and after 180 degrees of crank rotation this positon is reversed with the second ahead of the first.

Alternate forms of the engagement means allow in a first instance the engagement means associated with the lifted body being the engagement means which is actively engaged with the support surface and in a second instance the engagement means associated with the non-lifted body being the engagement means actively engaged with the support surface. Preferably in the first instance the engagement means would be a cam associated with the lifted body and in the second instance the engagement means would be a lever associated with the non-lifted body.

BRIEF DESCRIPTION OF THE DRAWINGS

This invention will be better understood when taken in conjunction with the drawings wherein.

Figure 1:
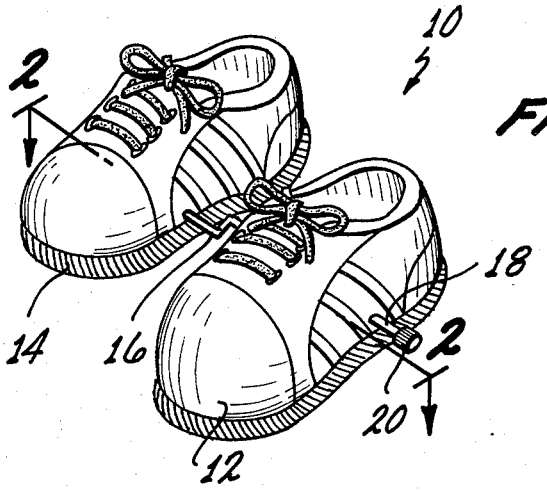
FIG. 1 is an isometric view of the toy of the invention.

The invention illustrated in the drawings and described in this specification utilizes certain principles and/or concepts which are set forth and claimed in the claims appended to this specification. Those skilled in the toy arts will realize that these principles and/or concepts are capable of being utilized in a variety of embodiments. For this reason this invention is to be construed in light of the claims and should not be construed as being limited to the exact illustrative embodiments shown herein.

DETAILED DESCRIPTION

The toy 10 of the invention is preferedly shaped as a pair of shoes such as the pair of sneakers illustrated in FIG. 1. The toy 10 has a first body 12, the left footed shoe of FIG. 1, and a second body 14, the right footed shoe of FIG. 1, which are connected together by a crank 16. Projecting out of the side of the body 12 is a shaft 18 having a knurled knob 20 located on its end. To use the toy the knob 20 is suitably rotated to energize the toy as hereinafter explained. The toy is then placed on a support surface and released. The first and second bodies essentially shuffle or walk across the support surface. This movement is accomplished by having first one of the bodies which is the most rearwardly displaced of the two bodies move up then forward and then downward to reposition itself slightly ahead of the other body, followed by the other of the bodies mimicing this motion. The motion is repeated with first one of the bodies moving forward and then the other of the bodies moving forward to propel the toy 10 across the support surface.

As the rearmost body moves upwardly, forwardly and then downwardly it is lifted off of the support surface. Each of the bodies contains a means as hereinafter explained which prevents the lifted body from tilting the total toy 10 sideways such that the stationary body in fact is not lifted off the surface. Without this means the two bodies 12 and 14 would simply rock about the roll axis of a pitched-yaw-roll axis system instead of moving in a forward walking motion.

Located within one of the bodies, body 12 for illustrative purposes, is a small spring motor 22. The shaft 18 connects to the spring motor and energizes the same when it is rotated. The motor 22 is fixedly located onto the bottom wall 24 of body 12. Projecting out of the side of the motor 22 is a short shaft (not separately numbered) and a pinion 26 which rotates in response to the motor.

Crank 16 has a first portion 28 associated with body 12, a second portion 30 associated with body 14 and a connecting portion 32 which aligns the first and second portions of 28 and 30 in a parallel non axial manner. In essence the connecting portion 32 can be considered as the mid point along the transverse axis of the toy 10.

Projecting upwardly from the bottom wall 34 of body 14 is a first and a second bearing 36 and 38 respectively. The second crank portion 30 rests on these bearings and is maintained in position by a bushing 40 which fits against the inside of bearing 38. The second body 14 is freely pivotable about the second crank portion 30.

The first crank portion 28 likewise fits into a bearing 42 extending above bottom wall 24 of the first body 12. A spur gear 44 mounts on first crank portion 28 on the inside of bearing 42. Spur gear 44 is fixedly attached to the first crank portion 28. Spur gear 44 has an anular shoulder 46 on its inside surface which is hollow and thus can serve as a bearing. This fits over end 48 of shaft 18. The anular shoulder 46 and the bearing 42 thus serve to journal first crank portion 28 with respect to the first body 12. Spur gear 44 engages with pinion 26 and is rotated in response to motion of this pinion. The body 12 then is not freely pivotable about the crank 16 as is the body 14 but its rotation with respect to the crank 12, or viewed in another way the rotation of the crank 16 with respect to the body 12, is governed by the rotation imparted to the spur gear 44 by the pinion 26.

Figure 2:
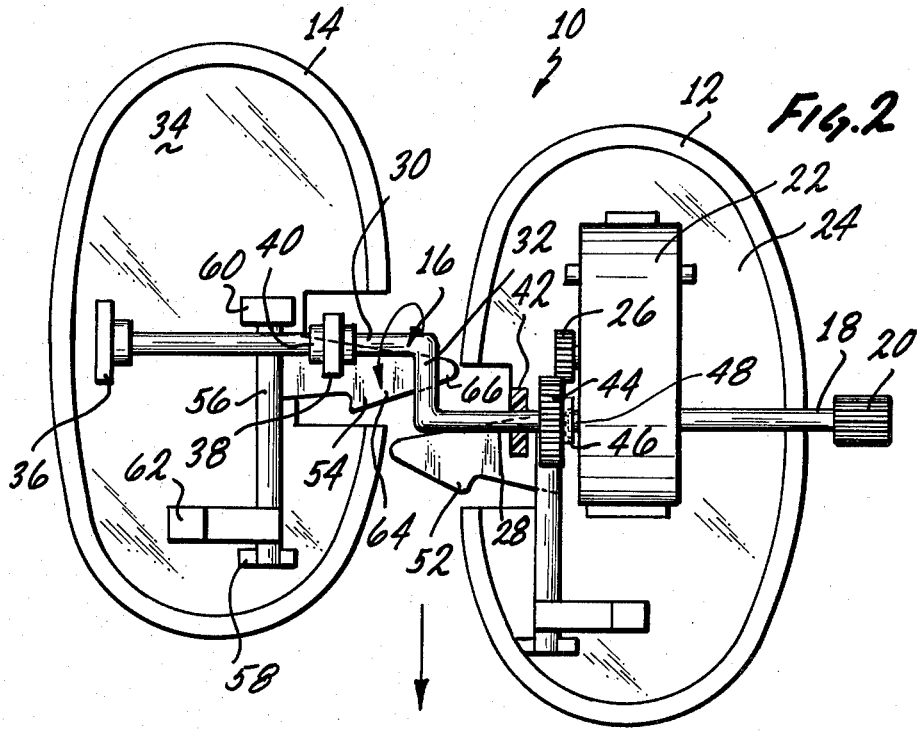
FIG. 2 is a top plan view about the line 2—2 of FIG. 1.
Figure 3:
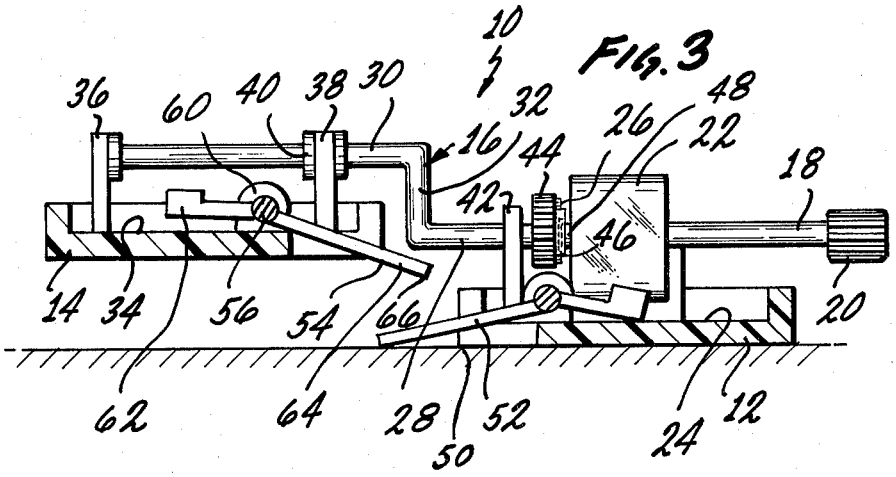
FIG. 3 is a front elevational view showing those components illustrated in FIG. 2 but with these components located in a different spatial relationship than that shown in FIG. 2, most particularly the crank of FIG. 2 has been rotated 90 degrees in FIG. 3.

As the crank 16 rotates from the position shown in FIG. 2 to the position shown in FIG. 3 the second body 14 is pivoted up off of the support surface. If the crank 16 were rotated 180 degrees from that shown in FIG. 2 (a position not illustrated in the figures) then further rotation of the shaft would cause the body 12 to rotate with respect to the crank 16 by virtue of pinion 26 rotating around the spur gear 44. Alternating these two motions causes first second body 14 to move upwardly, forwardly and then downwardly to be ahead of body 12 followed by body 12 moving upwardly, forwardly and downardly to once again be ahead of body 14.

Figure 4:
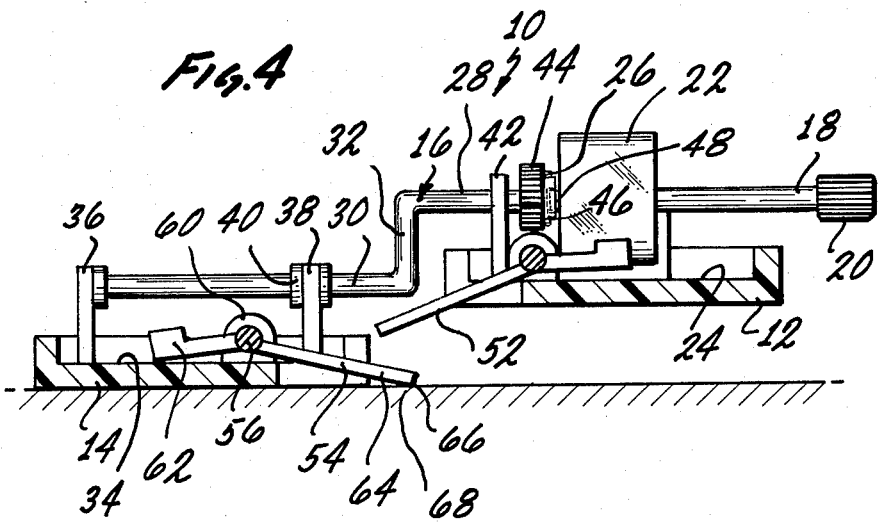
FIG. 4 is an elevational view similar to FIG. 3 except the crank has been rotated 180 degrees from FIG. 3 to relocate certain components with respect to one another.
Figure 5:
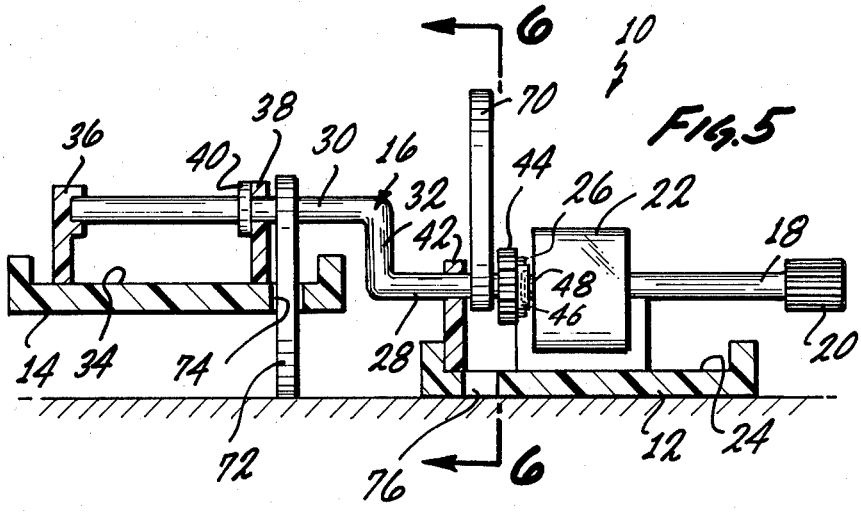
FIG. 5 is a front elevational view similar to FIG. 3 except an alternate form of the invention is illustrated.
Figure 6:
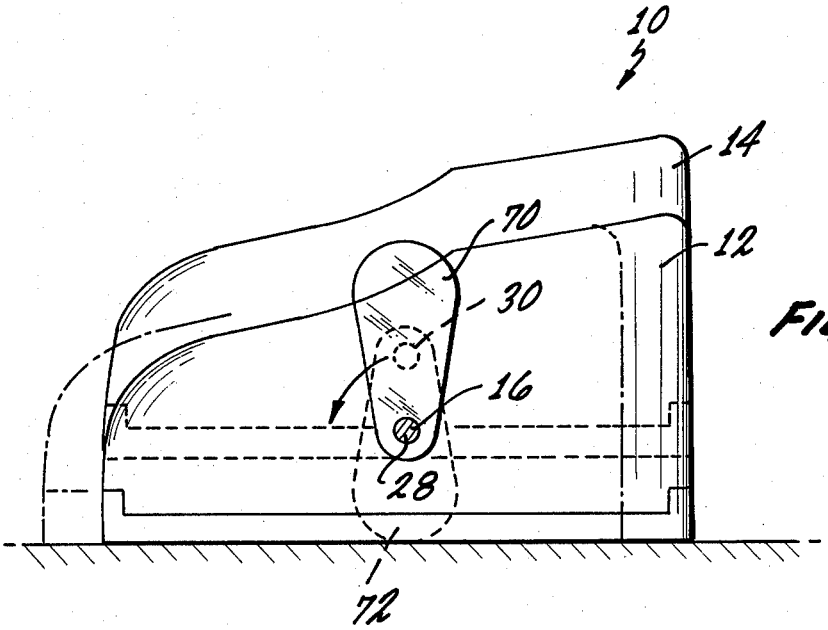
FIG. 6 is a side elevational view about the line 6—6 of FIG. 5.

Referring now to FIGS. 3 through 6 it can be seen that when one of the bodies is raised such as body 14 in FIG. 3 it could cause the toy 10 to roll about point 50 on the bottom wall 24 of body 12. If the toy 10 were allowed to roll in this manner it would not walk forward in a smooth step like manner but its motion would be erratic because of frictional forces from both bodies 14 and 12 against the support surfaces. FIGS. 2, 3 and 4 illustrate the first embodiment of a surface engagement means which prevents such "roll" motion upon rotation of crank 16 and FIGS. 5 and 6 illustrate a second embodiment of the surface engagement means.

In the first embodiment of this engagement means body 12 is provided with a lever member 52 and body 14 a lever member 54. The lever members 52 and 54 are in fact mirror images of each other. Each in fact acts as a first class lever even though at first blush they do not appear as first class levers. Since members 52 and 54 are mirror images, for the purposes of brevity in this specification only one will be descried in detail, it being understood that the other is identical except for its mirror image properties. Since member 52 is located in body 14, the body which does not contain the motor 22, the drawings are less encumbered with overlying parts and therefore the member 54 can better be seen than the member 52. For the purposes of description then the member 54 will be described.

The member 54 has a rod like portion 56 which is appropriately journaled to bearings 58 and 60 located on bottom surface 34 of bottom 14. The rod portion 56 thus serves as the fulcrum for the first class lever. Extending to the right of rod 56 is surface engagement portion 64. The bottom 34 of the body 14 is notched out below the surface engagement portion 64. This allows this portion to descend downwardly below the bottom wall 34. It is necessary for this portion to descend downwardly at certain instances in coordination with rotation of the crank 16 in order to clear the area in which the crank rotates such that the crank 16 does not get lodged against the portion 64.

The counterweight portion 62 of the member 54 however is not free to descend downwardly. Any movement downwardly from the horizontal by the counterweight portion 62 causes the counterweight portion 62 to abut against the bottom wall 34. This in effect prevents the surface engagement portion 64 from being able to be lifted above the horizontal. The counterweight portion 62 is weighted such that the member 54 is essentially balanced about the rod portion 56. Because the counterweight portion 62 is prevented from downward movement but is free to move upwardly whereas the engagement portion is free to move downwardly because of the presence of a slot in the body 14 but is prevented from moving upwardly because of the contact of the counterweight portion 62 with the bottom wall 34, the member 54 is therefore pivotable between a position wherein the member 54 is horizontal and a position wherein the engagement portion 64 moves downwardly out of the path of the travel of the crank 16.

The end 66 of the surface engagement portion 64 extends beyond the connecting portion 32 of the crank 16 to the side of the crank 16 occupied by the other body, first body 12. Thus the end 66 projects essentially beyond the center line of the toy 10 from the side where it is attached. Referring now to FIGS. 3 and 4 it can be seen that when body 14 is moving through its arc and is raised, member 54 pivots down out of the way of the travel of crank 16. When body 14 however is fixedly located on the support surface and body 12 is lifted, the member 54 contacts the support surface about the surface engagement portion 64. Since the surface engagement portion 64 cannot be tilted above the horizontal, the end 66 of this portion is firmly engaged with the support surface whenever the second body 14 is located on the support surface.

The weight of the body 12 in FIG. 4 would tend to pivot the body 14 about point 68 however because the end 66 of the surface engagement portion 64 extends beyond the center of the toy 10 to a point almost underneath the body 12 it provides an extension of the body 14 beyond point 68 and in fact beyond the center of the toy 10. By so locating the end 66 beyond the center of the toy, the raised body 12 cannot pivot the total toy 10 about the point 68 and thus the raised body 12 is maintained in the raised position and can freely move from a point behind body 14 to a point in front of body 14. Of course the same system works when the body 12 is in contact with the surface and the member 52 extends beyond the center of the toy 10 toward the raised body 14 as is shown in FIG. 3.

In the other embodiment of the engagement means illustrated in FIGS. 5 and 6, each of the bodies 12 and 14 include a cam 70 and 72, respectively, fixedly attached to the first and second crank portions 28 and 30, respectively. Each of the bottom walls 24 and 34, respectively, contain appropriate slots 74 and 76, respectively, through which the cams 70 and 72 can descend beyond the bottom walls 24 and 34 respectively. The cams are sized such that each of the cams 70 and 72 project beyond the bottom walls 24 and 34 respectively the same distance as the bottom walls are raised above the support surfaces. Further, the cams are shaped in cross section as seen in FIG. 6 such that the shape of their lobes is coordinated with the shape of the arc through which the bodies 12 and 14 move.

When the crank 16 is oriented such that the connecting portion 32 extends horizontally in a fore aft direction one or the other of the cams 70 or 72 is just beginning to contact the support surface. As the crank 16 rotates to a position wherein the connecting portion 32 is vertical such as that seen in FIG. 5 the surfaces of whichever of the cams 70 and 72 which is engaging with the support surface mimics the movement of the connection portion 32 between the horizontal and the vertical. Whichever of the bodies 12 or 14 is therefore raised above the support surface it is appropriately supported by its associated cam 70 or 72. Further the motion moving one of the bodies from behind the other body upwardly and then to a point in front of the other body is assisted by the rolling motion of a raised body about the curved surface of the cam as it moves on the support surface.

I claim:

1. A toy which comprises:

a first body and a second body associated with each other;

a crank means extending transversely between said first and said second bodies and rotatably connected to both of said first and said second bodies, said crank means forming the only connection between said first and said second bodies, said crank means having ends with one end terminating within said first body and the other end terminating within said second body;

means for rotating one end of said crank so as to operate said toy, during the operation of said toy said first and said second bodies moving on a support surface with respect to one another about said crank means, said movement sequentially comprising first having both of said bodies located on said support surface with said first body longitudinally displaced in a starting position with respect to said second body, secondly said second body moving through a pathway until said second body is repositioned on said support surface longitudinally with respect to said first body and thirdly said first body moving through a pathway until said first body is repositioned longitudinally with respect to said second body to locate said first and said second bodies in said starting position;

each of said first and said second bodies including a surface engagement means associated with it and capable of engaging said support surface, one of said engagement means of one of said first and said second bodies engaging said support surface as said first body moves in its pathway and the other of said engagement means of said first and said second bodies engaging said support surface as said second body moves in its pathway, said one of said surface engagement means which engages said surface as said first body moves in its pathway capable of impeding said second body from moving with respect to said support surface as said first body moves in its pathway, the other of said surface engagement means which engages with said surface as said second body moves in its pathway being capable of impeding said first body from moving with respect to said surface as said second body moves in its pathway.

2. The toy of claim 1 wherein each of said first and said second bodies moves in a pathway with is a 180 degree arc.

3. The toy of claim 2 wherein:

at least a portion of said first body is lifted above said support surface as said first body travels through said arc, at least a portion of said second body being lifted upwardly from said support surface as said second body moves through its arc;

each of said engagement means when engaged with said support surface capable of preventing the weight of at least that portion of said first or said second body which is lifted upwardly from said support surface as said body travels in said arc from tilting with respect to said support surface the other of said bodies which is in contact with said support surface.

4. The toy of claim 3 wherein:

said crank means comprises a crank having a first shaft portion, a second shaft portion and a connecting portion connecting said first and said second shaft portions in an essentially parallel non-axial relationship;

said crank means further including motor means capable of rotating at least one of said first or said second shaft portions;

said first shaft portion rotatably associated with said first body and said second shaft portion rotatably associated with said second body.

5. The toy of claim 4 including:

each of said first and said second bodies including bearing means, said first shaft portion rotatably mounting in said bearing means in said first body and said second shaft portion rotatably mounting in said bearing means of said second body;

said first and said second bodies associated with each other in a side by side orientation such that said bearing means of said first body when said first and said second bodies are in said first position is longitudinally displaced forward of said bearing means of said second body by a distance equal to the length of said connecting portion of said crank.

6. The toy of claim 5 wherein:

said engagement means associated with said first body engages said support surface as said first body moves through its arc and said engagement means associated with said second body engages said support surface as said second body moves through its arc.

7. The toy of claim 5 wherein:

said engagement means associated with said first body engages said support surface as said second body moves through its arc and said engagement means associated with said second body engages said support surface as said first body moves through its arc.

8. The toy of claim 6 wherein:

said engagement means associated with said first body comprises a first cam means fixedly attached to said first shaft portion and rotatable with said first shaft portion, said first cam means capable of descending below said first body and contacting said support surface as said first body moves through its arc;

said engagement means associated with said second body comprises a second cam means fixedly attached to said second shaft portion and rotatable with said second shaft portions, said second cam means capable of descending below said body and contacting said support surface as said second body moves through its arc.

9. The toy of claim 7 wherein:

each of said first and said second bodies includes a bottom wall, said bottom walls contacting said support surface when said first and said second bodies are located on said support surface;

said engagement means associated with said first body comprises a first lever means pivotedly mounted on the upper face of said bottom wall of said first body, a first end of said first lever means projecting from said first body towards said second body and extending beyond said connecting portion of said crank to a position adjacent said second shaft portion of said crank, the other end of said first lever means located over the upper face of said bottom wall of said body, said first lever means capable of tilting away from a horizontal orientation in a first direction when said first end of said lever means extends below the horizontal and the other end of said lever means is raised above the horizontal and said first lever means incapable of tilting from a horizontal orientation in a second direction which is opposite the first direction because of contact of said other end of said lever means with said upper face of said bottom wall of said first body;

said engagement means associated with said second body comprising a second lever means pivotedly mounted on the upper face of said bottom wall of said second body, a first end of said second lever means projecting from said second body toward said first body and extending beyond said connection portion of said crank to a position adjacent said first shaft portion of said crank, the other end of said second lever means located over the upper face of said bottom wall of said second body, said second lever means capable of tilting away from a horizontal orientation in a first direction when said first end of said second lever means extends below the horizontal and the other end of said lever means is raised above the horizontal and said second lever means incapable of tilting from a horizontal orientation in a second direction which is opposite the first direction because of contact of said other end of said lever means with the upper face of the bottom surface of said first body.

10. The toy of claim 8 wherein:

said motor means is located within said first body, said motor means operatively connected to said first shaft portion and capable of rotating said crank means with respect to said first body;

said second body freely rotatable on said second shaft portion about said bearing means in said second body.

11. The toy of claim 1 wherein:

said first body is shaped as one shoe of a pair of shoes and the second body is shaped as the other shoe of said pair of shoes.

12. The toy of claim 10 wherein:

said first body is shaped as one shoe of a pair of shoes and the second body is shaped as the other shoe of said pair of shoes.

13. A toy shaped as right and left members of a set of members;

crank means extending between said right and left members and rotatably associated with both of said members, said crank means forming the only association between said right and left members, said crank means having ends with one end terminating within said right member and the other end terminating within said left member;

a rotation means operatively associated with said crank means for rotating one end of said crank means;

said right and left member movable with respect to each other by rotation of said crank means by said rotation means; and a surface engagement means on each of said members, said engagement means on each of said members engaging a surface upon which said toy is moved as the other member is rotated with respect to it through the operation of said rotation means.

14. The toy of claim 13 wherein:

said right and left members each are shaped as one shoe of a pair of shoes.

15. A toy capable of moving over a support surface which comprises:

a fist body;

a second body;

a crank;

said first body rotatively mounted on one side of said crank and said second body rotatively mounted on the other side of said crank such that said crank forms the only connection between said first and said second bodies, said crank having ends with one end terminating within said first body and the other end terminating within said second body;

a motor located in said first body and capable of producing an output;

means operatively connecting said motor and said crank and capable of rotating said crank in response to said output of said motor;

a first means fixedly attaching to said one side of said crank and movable in response to rotation of said crank;

a second means fixedly attaching to said other side of said crank and movable in response to rotation of said crank;

said first and said second means positioned on said crank with respect to one another such that they alternately contact said support surface as said crank rotates, said first means lifting at least a portion of said first body off of said support surface as said first means contacts said support surface and said second means lifting at least a portion of said second body off of said support surface as said second means contacts said support surface.

16. The toy of claim 15 wherein:

said first and said second means further comprise a first and a second elongated member projecting radially from said crank.

17. The toy of claim 16 wherein:

said first and said second elongated members comprise a first and a second elongated cam.

18. The toy of claim 15 wherein:

said means operatively connecting said motor and said crank comprises a first and a second gear, said first gear fixedly attached to said crank and said second gear operatively attached to said motor and rotating to said response to output of said motor, said first and said second gears meshing with each other such that the output of said motor rotates said crank.

19. The toy of claim 18 wherein:

said first and said second means further comprise a first and a second elongated body projecting radially from said crank.

20. The toy of claim 19 wherein:

said first and said second elongated bodies comprise elongated cams.

21. A toy which comprises:

a crank;

a first body housing;

a second body housing;

said first and said second housings each having a bottom wall, said first body housing rotatively mounted on one side of said crank and said second body housing rotatively mounted on the other side of said crank with said crank forming the only connection between said first and said second body housings, said crank having ends with one end terminating within said first body housing and the other end terminating within said second body housing;

rotation means located in said first body housing for rotating said one end of said crank with respect to said first body housing;

a first means fixedly attached to and radially projecting from said one side of said crank and rotating in unison with said crank;

a second means fixedly attached to and radially projecting from the other side of said crank and rotating in unison with said crank;

said first and said second means positioned on said crank such that they do not radially project in the same direction so as when said crank rotates said first and said second means alternately radially project toward the plane of said respective bottom walls whereby said toy is supported on a surface upon which it is operated by said bottom walls of said housings alternately engaging said surface.

22. The toy of claim 21 including:

said bottom walls on said first and said second body housings each including an opening, said first means capable of alternately projecting through said opening in said bottom wall of said first housing and said second means capable of alternately projecting through said opening in said bottom wall of said second housing in response to rotation of said crank.

23. The toy of claim 22 wherein:

said first and said second means are positioned radially about said crank one hundred and eighty degrees apart from each other such that alternately first said first means is directed downwardly when said second means is directed upwardly and secondly said first means is directed upwardly when said second means is directed downwardly.

* * * * *

UNITED STATES PATENT AND TRADEMARK OFFICE

CERTIFICATE OF CORRECTION

PATENT NO. : 4,372,078

DATED : FEBRUARY 8, 1983

INVENTOR(S) : GORDEN W. SPRING

It is certified that error appears in the above-identified patent and that said Letters Patent is hereby corrected as shown below:

Column 6, line 68, Claim 1, "bodies" should read --bodies back--.

Column 7, line 21, Claim 2, "with is" should read --which is--.

Column 8, line 20, Claim 8, "body" should read --second body--.

Column 9, line 39, Claim 15, "fist" should read --first--.

Signed and Sealed this

*Twenty-first* Day of *June 1983*

[SEAL]

*Attest:*

DONALD J. QUIGG

*Attesting Officer*

*Acting Commissioner of Patents and Trademarks*

Disclaimer 4,372,078.—*Gorden W. Spring,* Norwalk, Calif. TOY MOVABLE BY ALTERNATELY RELOCATING INDIVIDUAL MEMBERS OF A PAIR OF BODY PARTS. Patent dated Feb. 8, 1983. Disclaimer filed Dec. 28, 1983, by the assignee, *Tomy Corp.*

Hereby enters this disclaimer to claims 1–23 of said patent.

[*Official Gazette February 12, 1985.*]